US008189838B1

(12) United States Patent
Rich

(10) Patent No.: US 8,189,838 B1
(45) Date of Patent: May 29, 2012

(54) ORAL HEARING AID DEVICE AND METHOD OF USE THEREOF

(76) Inventor: Donna L. Rich, Florence, AL (US)

( * ) Notice: Subject to any disclaimer, the term of this patent is extended or adjusted under 35 U.S.C. 154(b) by 1080 days.

(21) Appl. No.: 12/082,720

(22) Filed: Apr. 14, 2008

Related U.S. Application Data

(60) Provisional application No. 60/923,207, filed on Apr. 13, 2007.

(51) Int. Cl.
*H04R 25/00* (2006.01)

(52) U.S. Cl. ..... 381/326; 381/151

(58) Field of Classification Search ..... 381/326
See application file for complete search history.

(56) References Cited

U.S. PATENT DOCUMENTS 3,985,977 A 10/1976 Beaty et al.
4,498,461 A 2/1985 Hakansson
4,612,915 A 9/1986 Hough et al.
4,672,673 A * 6/1987 Katz et al. ..... 381/70
5,326,349 A 7/1994 Baraff
5,447,489 A * 9/1995 Issalene et al. ..... 600/25
5,579,284 A 11/1996 May
5,902,167 A 5/1999 Filo et al.
6,115,477 A 9/2000 Filo et al.
6,633,747 B1 * 10/2003 Reiss ..... 455/41.2
7,071,844 B1 7/2006 Moise
7,724,911 B2 * 5/2010 Menzel et al. ..... 381/151

* cited by examiner

*Primary Examiner* — Elvin G Enad
*Assistant Examiner* — Christopher Uhlir
(74) *Attorney, Agent, or Firm* — Montgomery Patent & Design, LLC; Robert C. Montgomery; Joseph T. Yaksich

(57) ABSTRACT

An electronic hearing device embedded thereinto a molded denture placed therein a user's mouth and fastened thereto the user's teeth allowing said teeth and related facial bone structure to conduct sounds received by said hearing device thereto the bones of the middle ear and subsequently to the brain for conversion into understandable language and sounds is herein disclosed. The hearing device may be used in conjunction with traditional ear-mounted hearing aids. The hearing device comprises expected electronic components such as an inout transducer, output transducers, a battery, a volume control, wires, and the like components fastened thereto or embedded thereinto a custom molded orthodontic appliance or normal denture plate and fastened to rear upper molars. The invention allows the user to turn the hearing device on and off or to adjust volume using their tongue.

15 Claims, 4 Drawing Sheets

ORAL HEARING AID DEVICE AND METHOD OF USE THEREOF

RELATED APPLICATIONS

The present invention was first described in and claims the benefit of U.S. Provisional Application No. 60/923,207 filed on Apr. 13, 2007, the entire disclosures of which are incorporated herein by reference.

FIELD OF THE INVENTION

The present invention relates generally to a hearing aid device for an individual and, more particularly, to said hearing aid device that is worn in a mouth of a user, receives ambient sound waves, converts said sound waves into a tactile signal, and transmits said signal through the facial bone structure of said user thereto an auditory system of a user.

BACKGROUND OF THE INVENTION

Hearing aids are used by a large number of people to help restore their hearing to a suitable level. Whether the hearing loss was caused by an accident, excessive loud noise, old age, a genetic abnormality or the like, the hearing aid allows these people to overcome their disability and become a full functioning member of society. However, hearing aids come with some disadvantages as well. First, they are easily seen by others either on the inside or outside of the ear, and are not very discrete. Secondly, their volume is difficult to adjust often requiring their removal and reinsertion on a repeated basis to get it right. Then as the user moves, or ambient noise levels change, the entire process must be repeated. Finally, there are instances where the user wishes to turn off the hearing aids, which also may require their removal. The features and benefits of the present invention address these concerns.

U.S. Pat. No. 7,071,844 filed by Moise discloses a mouth mounted input device. This patent does not appear to disclose a hearing aid device that is incorporated into a dental prosthesis.

U.S. Pat. No. 6,633,747 filed by Reiss discloses an orthodontic appliance audio receiver. This patent does not appear to disclose a hearing aid device that is incorporated into a dental prosthesis that is in communication with the hard palate of the user.

U.S. Pat. No. 6,115,477 filed by Filo and Capper discloses a denta-mandibular sound-transmitting system. This patent does not appear to disclose a hearing aid device that is incorporated into a dental prosthesis that is in communication with the hard palate of the user.

U.S. Pat. No. 5,902,167 filed by Filo and Capper discloses a sound-transmitting amusement device and method. This patent does not appear to disclose a hearing aid device that is incorporated into a dental prosthesis that is in communication with the hard palate of the user.

U.S. Pat. No. 5,579,284 filed by May discloses a scuba diving voice and communication system using bone conducted sound. This patent does not appear to disclose a hearing aid device that is incorporated into a dental prosthesis.

U.S. Pat. No. 5,447,489 filed by Issalene et al. discloses a bone conduction hearing aid device. This patent does not appear to disclose a hearing aid device that is incorporated into a dental prosthesis and possesses an integral power switch and tongue activated volume control.

U.S. Pat. No. 5,326,349 filed by Baraff discloses a artificial larynx. This patent does not appear to disclose a hearing aid device.

U.S. Pat. No. 4,612,915 filed by Hough et al. discloses a direct conduction hearing aid device. This patent does not appear to disclose a hearing aid device that is incorporated into a dental prosthesis that is in communication with the hard palate of the user.

U.S. Pat. No. 4,498,461 filed by Hakansson discloses a coupling to a bone-anchored hearing aid. This patent does not appear to disclose a hearing aid device that is incorporated into a dental prosthesis.

U.S. Pat. No. 3,985,977 filed by Beaty and Severson discloses a receiver system for receiving audio electrical signals. This patent does not appear to disclose a hearing aid device that is incorporated into a dental prosthesis and possesses an integral power switch and tongue activated volume control.

The prior art appears to disclose devices that assist with user's hearing. The prior art does not appear to disclose a hearing aid device that is incorporated into a dental prosthesis possesses an integral power switch and tongue activated volume control and is in direct communication with the hard palate of the user.

SUMMARY OF THE INVENTION

In view of the foregoing disadvantages inherent in the prior art, it has been observed that there is need for an oral hearing aid device.

The oral hearing aid device is embedded thereinto a molded denture placed therein a user's mouth and fastened thereto the user's teeth. The oral hearing aid device receives and converts received ambient sound waves into output vibrations allowing said teeth and the related facial bone structure to conduct said vibrations thereto the middle bones of the middle ear and subsequently to the user's brain for conversion into understandable language and sounds.

A further aspect of the oral hearing aid device may be used in conjunction with traditional ear mounted hearing aids. The oral hearing aid device comprises expected electronic components as well as features which allow the user to turn the device on and off or to adjust volume using his/her tongue.

Still a further aspect of the oral hearing aid device is to place the device thereupon a roof portion of said mouth being affixed thereto a user's teeth via outwardly extending stainless steel support braces. The oral hearing aid device would pick up or intercept sound waves that pass through an area of the mouth by use of an input transducer. The device is in contact with a bone structure of the head of the user via mechanical connection thereof the support braces and the teeth or directly thereto the bone structure if no teeth are present. In such a manner, incoming sound waves are received by the device, conditioned electronically, amplified, and converted into output vibrations using an output transducer, and in turn conducted into the teeth and bone structure. The output vibrations produced will travel through the bone structure in the head of the user where they will be intercepted by the bones of the middle ear and converted by the brain of the user and interpreted as sounds, voices, music, and the like.

Yet still a further aspect of the oral hearing aid device is to incorporate the device therein a normal prosthetic denture providing replacement teeth in an expected manner or may provide exclusive utilization of the device without additional prosthetic teeth. The foundation for the denture would be made to fit the mouth of the user using well-known denture molding processes.

Another object of the oral hearing aid device comprises a battery compartment located on an upper surface of the denture. The battery compartment comprises a cylindrical-shaped enclosure providing a housing means thereto a battery. The battery is held in position with a securing device threadingly attached to an outer surface of the battery compartment such that it will not easily become loose while being worn by the user. The securing device comprises a slot or similar feature, thereby facilitating easy removal of the battery. Additionally, the securing device comprises a waterproof seal. The battery compartment and the securing device allow the user to easily replace the internal battery as required.

Yet another object of the oral hearing aid device to further comprise the battery compartment in electrical communication therewith an amplifier via embedded interconnecting wiring which further comprises an input transducer. The input transducer is located in a generally intermediate position of the denture molding where it can easily receive sounds. The input transducer produces an electrical signal which is amplified by an amplifier which also contains sound-conditioning circuitry to tailor an output signal so as to mimic an actual sound as would be heard through a normal human ear.

Still yet another object of the oral hearing aid device further comprises an amplifier that provides mechanical and electrical attachment thereto a pair of output transducers via outwardly extending support braces partially embedded therein the denture. The support braces provide an attachment means therebetween the device and the natural teeth of the user. Other common methods of orthodontic appliance attachment may be used therebetween the support brace portions and the teeth used to attach wire-based orthodontic plates and the like.

Still yet another object of the oral hearing aid device further comprise support braces that provide a hollow electrical conduit means allowing routing of wiring conducting an electrical output signal therefrom the amplifier thereto respective output transducers being attached thereto outer end portions of said support braces. Said electrical output signals are converted back into mechanical signals via a pair of output transducers located on either side of the denture towards a rear portion thereof. The output transducers comprise a speaker device similar in nature to audio speakers.

Still yet another object of the oral hearing aid device further comprises an amplifier in electrical communication therewith a power switch located on the underside of the denture molding via a tubular metal conduit and internal wiring therebetween. Said power switch is located along a rearward edge of the denture allowing the user to deactivate the device. The power switch comprises a pressure contact device providing an alternating on/off function when contacted by the user's tongue.

Still yet another object of the oral hearing aid device further comprises a volume control to adjust an amplification level of the device. The volume control comprises a rotary-type adjustment component being similar to common hearing aid volume controls. The volume control provides an adjustment means using one's tongue to increase or decrease said volume level. However, it is understood that other types of volume adjustments such as pressure switches, up or down switches, and the like, could be used with equal effectiveness, and as such, should not be interpreted as a limiting factor of the present invention. Both the power switch and the volume control can be operated by the tongue of the user while the device is inside the mouth or by using one's finger when the device is removed therefrom the mouth.

The oral hearing aid device would be manufactured on a personal basis, as conventional orthodontics require custom fitting and fabrication by a professional. A custom cast resulting in the denture molding or specifically designed support braces would be the result. At this point in time, the battery access cover, the input transducer, the amplifier, the output transducers, the power switch, the volume control, along with associated components such as interconnecting wiring would be embedded therein said denture. A battery would then be added thereto the battery compartment and the hearing device would be ready for use.

A method for installing and utilizing an oral hearing aid device may be used by performing the following steps: procuring a particular model, or models, of the oral hearing aid device; loading a fresh battery thereinto the battery compartment using the securing device and appropriate tool; inserting the device thereonto an upper palate area of the mouth; engaging the support braces thereto opposing upper rear molar pairs within the mouth; securing the device in place in a manner identical to conventional dentures or orthodontic plates; activating the power switch portion of the device using one's tongue; adjusting the volume control using one's tongue; and, benefiting therefrom an improved and discrete auditory experience afforded the user of the present invention.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
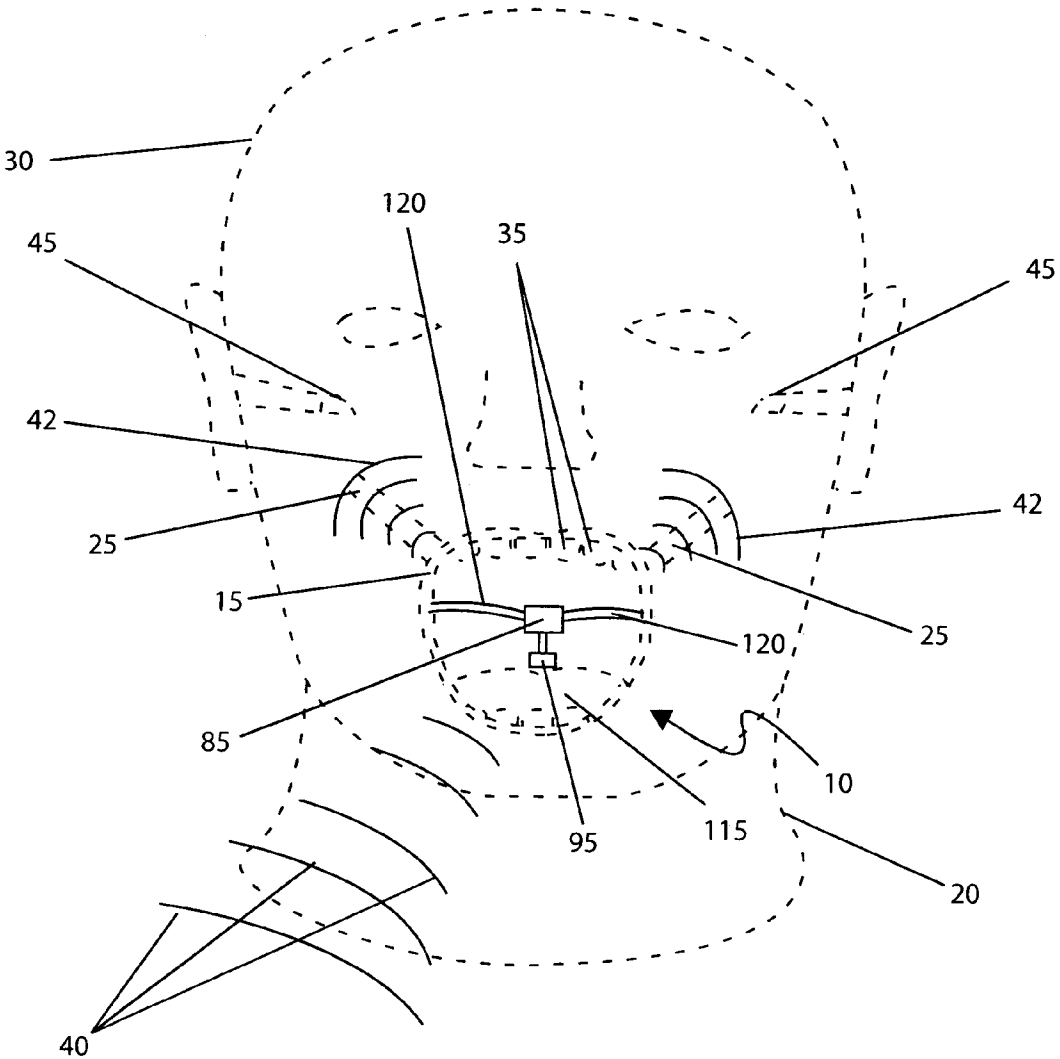
FIG. 1 is a pictorial representation of the oral hearing aid device 10 shown in a utilized state, according to a preferred embodiment of the present invention.

| DESCRIPTIVE KEY | |
|---|---|
| 10 | oral hearing aid device |
| 15 | mouth |
| 20 | user |
| 25 | bone structure |
| 30 | head |
| 35 | teeth |
| 40 | incoming sound wave |
| 42 | output vibration |
| 45 | middle ear |
| 50 | brain |
| 65 | denture |
| 70 | battery compartment |
| 75 | securing device |
| 80 | input transducer |
| 85 | amplifier |
| 90 | output transducers |
| 95 | power switch |
| 96 | wiring |
| 97 | conduit |
| 100 | volume control |
| 105 | mouth mounted enclosure |
| 110 | bottom face |

-continued

| DESCRIPTIVE KEY | |
|---|---|
| 115 | tongue |
| 120 | support braces |
| 125 | upper rear molar pair |
| 130 | battery |
| 135 | conditioning circuit |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an oral hearing aid device (herein described as the "device") 10, being embedded thereinto a molded denture 65 placed therein a user's mouth 15 and fastened thereto the user's teeth 35. The device 10 receives and converts received ambient sound waves 40 into output vibrations 42 allowing said teeth 35 and related facial bone structure 25 to conduct said vibrations 42 thereto bones of the middle ear 45 and subsequently to the user's brain for conversion into understandable language and sounds. The device 10 may be used in conjunction with traditional ear mounted hearing aids. The hearing device 10 comprises expected electronic components as well as features which allow the user 20 to turn the device 10 on and off or to adjust volume using his/her tongue 115.

Referring now to FIG. 1, a pictorial representation of the device 10 shown in a utilized state, according to the preferred embodiment of the present invention, is disclosed. The device 10 is observed here therethrough a user's mouth opening 15 and is placed thereupon a roof portion of said mouth 15 being affixed thereto a users teeth 35 via outwardly extending stainless steel support braces 120. The device 10 would pick up or intercept sound waves 40 that pass through an area of the mouth 15 by use of an input transducer 80. The device 10 is in contact with a bone structure 25 of the head 30 of the user 20 via mechanical connection thereof the support braces 120 and the teeth 35 or directly thereto the bone structure 25 if no teeth 35 are present. In such a manner, incoming sound waves 40 are received by the device 10, conditioned electronically, amplified, and converted into output vibrations 42 using an output transducer 90, and in turn conducted into the teeth 35 and bone structure 25. The output vibrations 42 produced will travel through the bone structure 25 in the head 30 of the user 20 where they will be intercepted by the bones of the middle ear 45 and converted by the brain of the user 20 and interpreted as sounds, voices, music, and the like.

Figure 2:
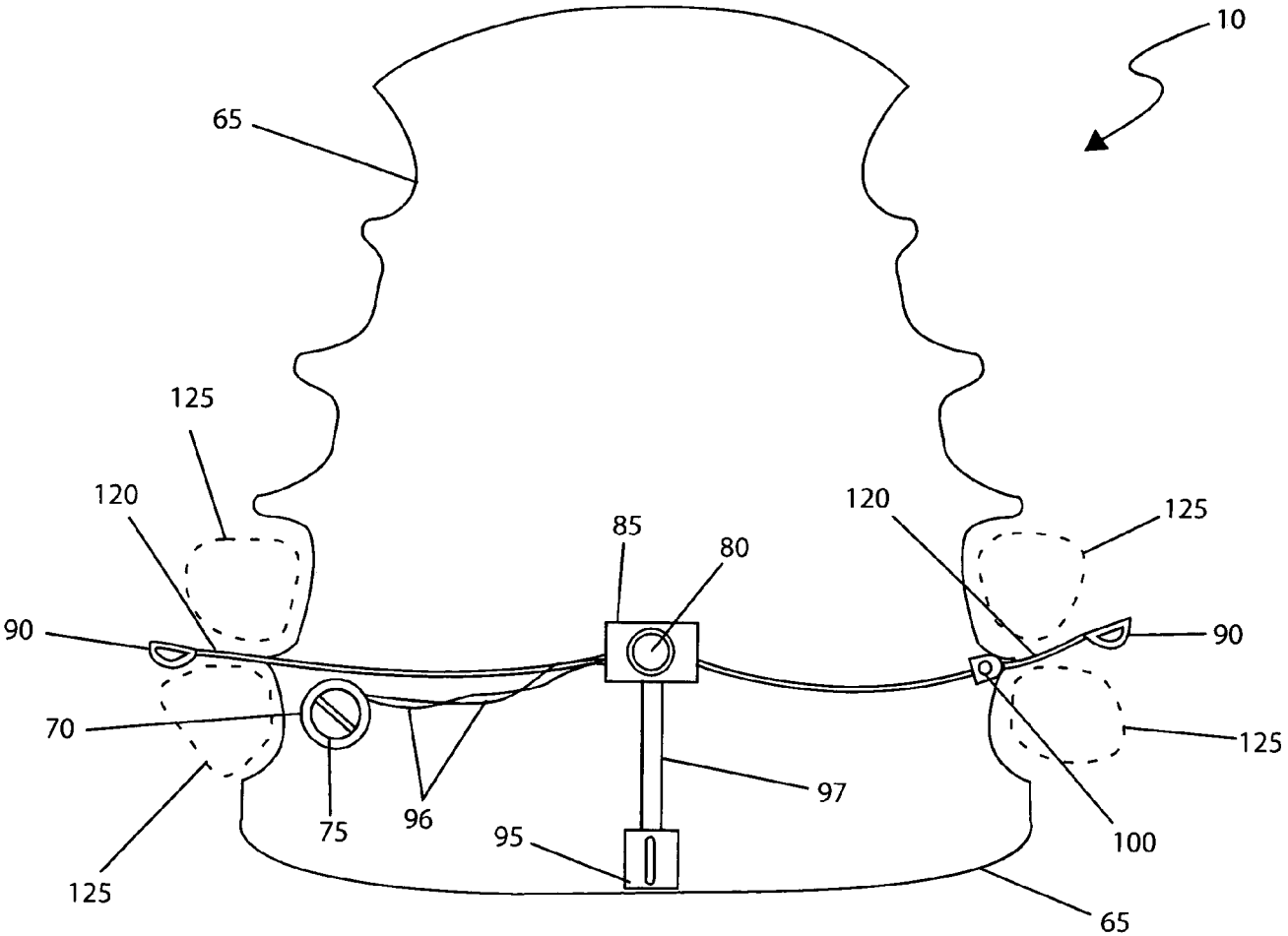
FIG. 2 is a bottom view of the oral hearing aid device 10 shown imbedded within a denture molding 65, according to a preferred embodiment of the present invention.
Figure 3:
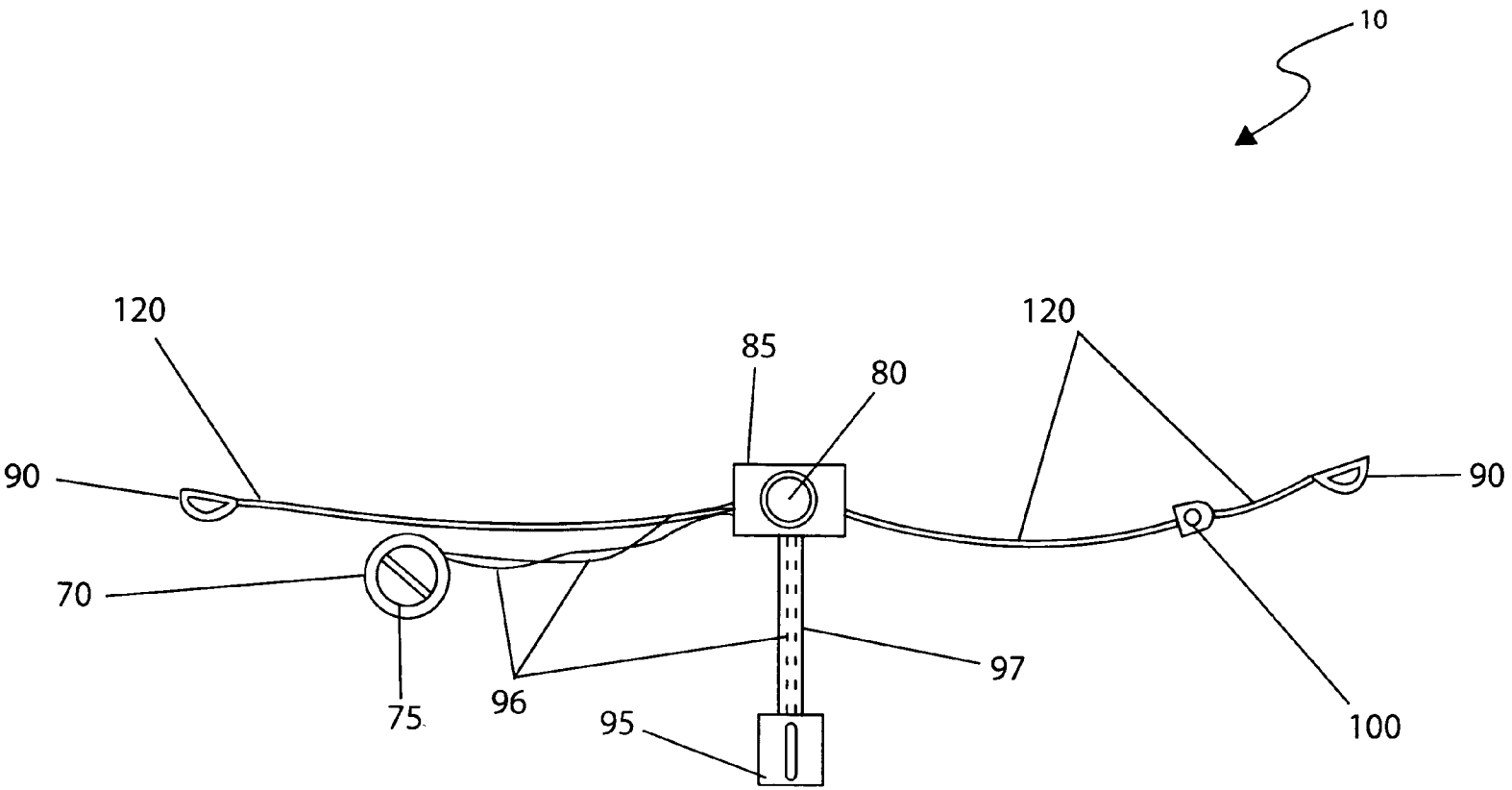
FIG. 3 is a detailed isometric view of the oral hearing aid device 10 shown in a removed state, according to a preferred embodiment of the present invention; and, FIG. 4 is an electrical block diagram depicting the electrical components as used with the oral hearing aid device 10, according to a preferred embodiment of the present invention.

Referring now to FIGS. 2 and 3, a bottom and a close-up view of the device 10, according to the preferred embodiment of the present invention, are disclosed. The features and components of the oral hearing aid device 10 may be incorporated therein an upper denture 65 of a user 20. The device 10 may be incorporated therein a normal prosthetic denture 65 providing replacement teeth in an expected manner or may provide exclusive utilization of the device 10 without additional prosthetic teeth. The foundation for the denture 65 would be made to fit the mouth 15 of the user 20 using well-known denture molding processes. A battery compartment 70 is located on an upper surface of the denture 65. The battery compartment 70 comprises a cylindrical-shaped enclosure providing a housing means thereto a battery 130 (see FIG. 4). The battery 130 is held in position with a securing device 75 being threadingly attached thereto an outer surface of the battery compartment 70 such that it will not easily become loose while being worn by the user 20. The securing device 75 comprises a slot or similar feature, thereby facilitating easy removal of the battery 130 using a small screwdriver or similar tool. Additionally, the securing device 75 comprises a perimeter seal providing a waterproof function as well. The battery compartment 70 and the securing device 75 allow the user 20 to easily replace the internal battery 130 as required. The battery compartment 70 is in electrical communication therewith an amplifier 85 via embedded interconnecting wiring 96 which further comprises an input transducer 80. The input transducer 80 is located thereat a generally intermediate position of the denture molding 65 where it can easily receive sounds 40 such as music, talking, ambient noise, and the like. The input transducer 80 produces an electrical signal which is amplified by an amplifier 85 which also contains sound-conditioning circuitry to tailor an output signal so as to mimic an actual sound as would be heard through a normal human ear. The output of the amplifier 85 provides mechanical and electrical attachment thereto a pair of output transducers 90 via outwardly extending support braces 120 being partially embedded therein the denture 65. The support braces 120 provide an attachment means therebetween the device 10 and the natural teeth of the user 20 illustrated here being inserted and secured therebetween adjacent upper rear molars 125. However, other common methods of orthodontic appliance attachment may be used therebetween the support brace portions 120 and the teeth 35 used to attach wire-based orthodontic plates and the like. The support braces 120 further provide a hollow electrical conduit means allowing routing of wiring 96 conducting an electrical output signal therefrom the amplifier 85 thereto respective output transducers 90 being attached thereto outer end portions of said support braces 120. Said electrical output signals are converted back into mechanical signals via a pair of output transducers 90 located on either side of the denture 65 towards a rear portion thereof. The output transducers 90 comprise a speaker device similar in nature to audio speakers. The amplifier 85 is in electrical communication therewith a power switch 95 located on the underside of the denture molding 65 via a tubular metal conduit 97 and internal wiring 96 therebetween. Said power switch 95 is located along a rearward edge of the denture 65 allowing the user 20 to deactivate the device 10 should its use not be desired. The power switch 95 comprises a pressure contact device providing an alternating on/off function when contacted by the user's tongue 115. Also located on the underside of the denture 65 is a volume control 100 allowing the user 20 to adjust an amplification level of the device 10. The volume control 100 comprises a rotary-type adjustment component being similar to common hearing aid volume controls. The volume control 100 provides an adjustment means using one's tongue 115 to increase or decrease said volume level. However, it is understood that other types of volume adjustments such as pressure switches, up or down switches, and the like, could be used with equal effectiveness, and as such, should not be interpreted as a limiting factor of the present invention 10. Both the power switch 95 and the volume control 100 can be operated by the tongue 115 of the user 20 while the device 10 is inside the mouth 15 or by using one's finger when the device 10 is removed therefrom the mouth 15.

Figure 4:
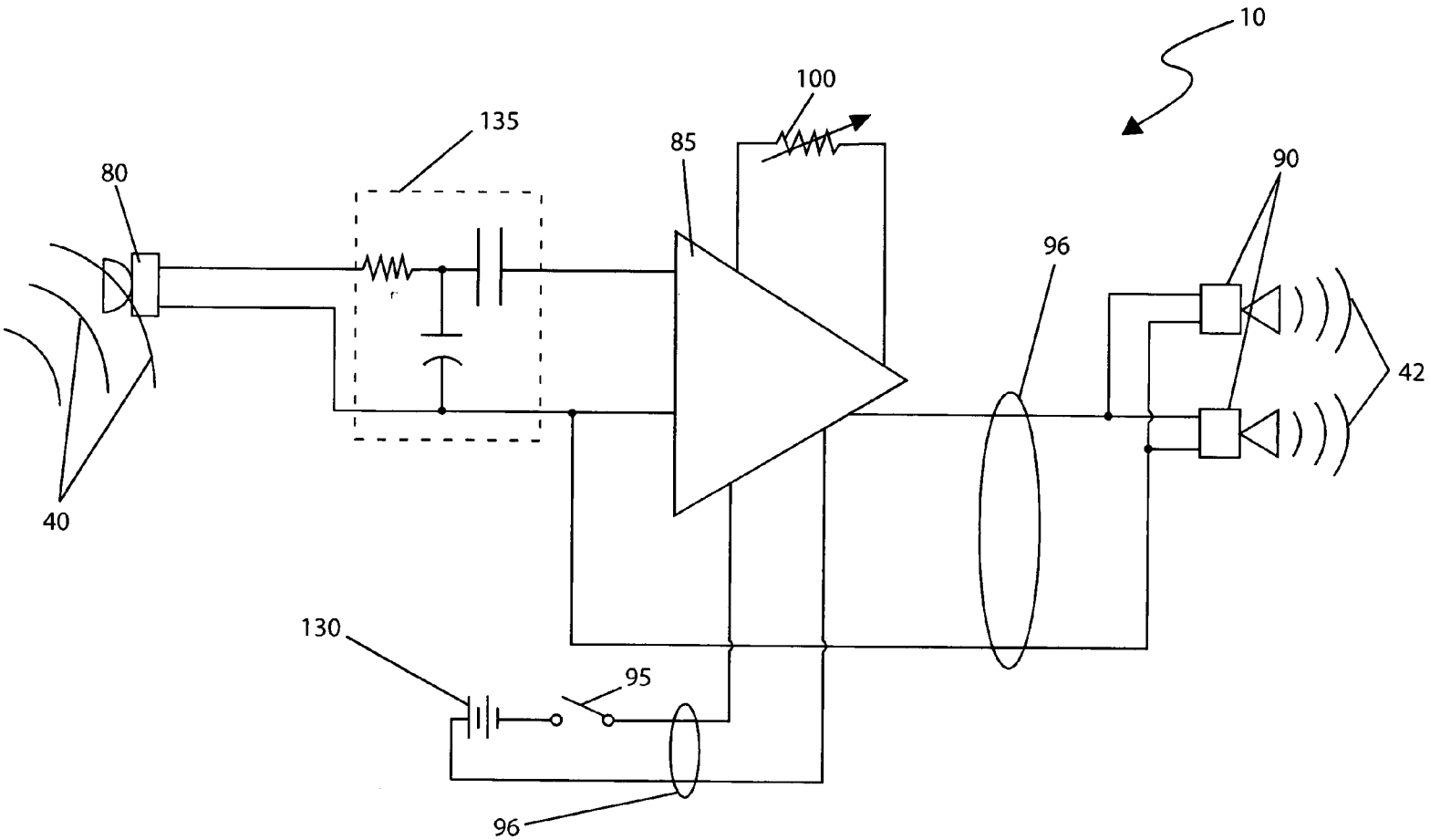

Referring now to FIG. 4, an electrical block diagram depicting the electrical components as used with the oral hearing aid device 10, according to a preferred embodiment of the present invention, is disclosed. Those skilled in the art will recognize that the sound conditioning circuitry 135 and amplification circuitry 85 are nearly identical to those used in conventional hearing aids and/or other sound amplification devices. The battery 130 comprises a miniature component being similar to common hearing aid batteries and provides electrical power to the hearing device 10 as controlled through the power switch 95. The input signal generated by the input transducer 80 is routed thereto a conditioning circuit 135 where conventional bandpass filters remove unnecessary wavelengths from the sound to be amplified. Finally, the output of the conditioning circuit 135 is routed to the amplifier 85 being controlled by the volume control 100. The conditioned and amplified output signal is then routed thereto the two (2) output transducers 90 in a parallel fashion.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of installing and utilizing the device 10 may be achieved by performing the following steps: loading a fresh battery 130 thereinto the battery compartment 70 using the securing device 75 and appropriate tool; inserting the device 10 thereonto an upper palate area of the mouth 15; engaging the support braces 120 thereto opposing upper rear molar pairs 125 within the mouth 15; securing the device 10 in place in a manner identical to conventional dentures or orthodontic plates; activating the power switch portion 95 of the device 10 using one's tongue 115; adjusting the volume control 100 using one's tongue; and, benefiting therefrom an improved and discrete auditory experience afforded the user 20 of the present invention 10.

As incoming sound waves 40 are intercepted by the input transducer 80, they are conditioned, amplified, and converted thereinto output vibrations 42 which in turn are relayed into the bone structure 25 of the head 30 of the user 20. The sound waves will then be intercepted by the bones of the middle ear 45 where they will be converted to readily recognizable signals by the brain of the user 20 and interpreted as sounds, voices, music, and the like. When finished with the device 10, the user 20 can deactivate it and/or remove it therefrom their mouth 15 being ready to be used again in a repetitive manner.

As conventional orthodontics require custom fitting and fabrication by a professional, the device 10 would be manufactured on a personal basis as well. It is envisioned that the fitting process would take place in an office of an orthodontics professional due to the customization which is involved. A custom cast resulting in the denture molding 65 or specifically designed support braces 120 would be the result. At this point in time, the battery access cover 70, the input transducer 80, the amplifier 85, the output transducers 90, the power switch 95, the volume control 100, along with associated components such as interconnecting wiring 96 would be embedded therein said denture 65. A battery 130 would then be added thereto the battery compartment 70 and the hearing device 10 would be ready for use.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A hearing assist device comprising an oral denture for placement within a mouth of a user, further comprising:

outwardly extending stainless steel support braces;

a hearing aid embedded therein said denture; and, a power source in electrical communication therewith said hearing aid via embedded interconnecting wiring;

wherein said hearing aid is located at a generally intermediate position of said denture and further comprising:

an input transducer comprising sound-conditioning circuitry;

an amplifier in electrical communication with said input transducer;

a pair of output transducers located on opposing sides of said denture adjacent to upper rear molars of teeth or facial bone structure; and, a volume control means in electrical communication with said hearing aid and said pair of output transducers located on an underside portion of said denture;

wherein said input transducer produces an electrical output signal which is amplified by said amplifier;

wherein said amplifier provides a mechanical and an electrical attachment means thereto said pair of output transducers via said outwardly extending support braces;

wherein said pair of output transducers convert said electrical output signal into output vibrations; and, wherein said volume control means further comprises a rotary-type adjustment component for providing a volume adjustment means to increase or decrease a volume level when contacted by said user;

wherein said denture is placed therein an upper palate portion of said mouth of said user;

wherein said device is in contact with said facial bone structure of a head of said user via mechanical connection thereof said support braces and teeth or said bone structure if no teeth are present;

wherein said hearing aid intercepts ambient sound waves that pass through an area of said mouth;

wherein said ambient sound waves are conditioned electronically, amplified, and converted into said output vibrations; and, wherein said output vibration are conducted thereinto said teeth and facial bone structure, travel through said facial bone structure thereto an auditory system of said user, and processed and interpreted by said user into an audible signal.

2. The device of claim 1, wherein said denture further comprises a custom-fitted design to fit said mouth of said user.

3. The device of claim 1, wherein said support braces provide an attachment means therebetween said hearing aid and said teeth of said user and a hollow electrical conduit means allowing routing of said wiring conducting an electrical output signal therefrom said hearing aid thereto said teeth or facial bone structure.

4. The device of claim 3, wherein said support braces are inserted and secured therebetween adjacent upper rear molars.

5. The device of claim 1, further comprising a power switch in electrical communication therewith said hearing aid located thereon an underside portion of said denture therethrough a tubular metal conduit.

6. The device of claim 5, wherein said power switch further comprises a pressure contact device providing an alternating on/off function when contacted by said user.

7. The device of claim 1, wherein said input transducer further comprises a conditioning circuit wherein conventional bandpass filters remove unnecessary wavelengths from said electrical output signal prior to amplification.

8. The device of claim 1, wherein said power source further comprises:

a battery compartment in electrical communication therewith said hearing aid located on an upper surface of said denture, comprising an enclosure providing a housing means therefor a battery;

a securing device threadingly attached thereto an outer surface of said battery compartment for securing said battery; and, a perimeter seal providing a waterproof means thereto said battery.

9. A hearing assist device comprising an oral denture for placement within a mouth of a user, further comprising:

a hearing aid embedded therein said denture, further comprising:

an input transducer comprising sound-conditioning circuitry;

an amplifier in electrical communication therewith said input transducer;

a pair of output transducers located on opposing sides of said denture;

a power switch in electrical communication therewith said amplifier therethrough a tubular metal conduit located thereon an underside portion of said denture; and, a volume control means in electrical communication therewith said amplifier and said pair of output transducers located thereon an underside portion of said denture;

a power source in electrical communication therewith said hearing aid via embedded interconnecting wiring; and, outwardly extending stainless steel support braces providing an attachment means therebetween said hearing aid and said user and further comprising a hollow electrical conduit means for allowing routing of said wiring conducting an electrical output signal therefrom said hearing aid thereto said user;

wherein said denture is placed therein an upper palate portion of said mouth of said user;

wherein said device is in contact with a facial bone structure of a head of said user via mechanical connection thereof said support braces and teeth or said bone structure if no teeth are present;

wherein said hearing aid intercepts ambient sound waves that pass through an area of said mouth;

wherein said input transducer produces an electrical output signal which is amplified by said amplifier;

wherein said amplifier provides a mechanical and an electrical attachment means thereto said pair of output transducers via said outwardly extending support braces;

wherein said pair of output transducers convert said electrical output signal into said output vibrations;

wherein said volume control means further comprises a rotary-type adjustment component for providing a volume adjustment means to increase or decrease a volume level when contacted by said user; and, wherein said output vibrations are conducted thereinto said teeth and facial bone structure, travel through said facial bone structure thereto an auditory system of said user, and processed and interpreted by said user into an audible signal.

10. The device of claim 9, wherein said denture further comprises a custom-fitted design to fit said mouth of said user.

11. The device of claim 9, wherein said support braces are inserted and secured therebetween adjacent upper rear molars.

12. The device of claim 9, wherein said power switch further comprises a pressure contact device providing an alternating on/off function when contacted by said user.

13. The device of claim 9, wherein said input transducer further comprises a conditioning circuit wherein conventional bandpass filters remove unnecessary wavelengths from said electrical output signal prior to amplification.

14. The device of claim 9, wherein said power source further comprises:

a battery compartment in electrical communication therewith said hearing aid located on an upper surface of said denture, comprising an enclosure providing a housing means therefor a battery;

a securing device threadingly attached thereto an outer surface of said battery compartment for securing said battery; and, a perimeter seal providing a waterproof means thereto said battery.

15. A method of installing and utilizing a hearing assist device embedded therein a denture for placement within a mouth of a user comprises the following steps:

providing said device comprising a hearing aid embedded therein said denture, further comprising:

an input transducer comprising sound-conditioning circuitry for producing an electrical output signal and comprising a conditioning circuit;

an amplifier in electrical communication therewith said input transducer;

a pair of output transducers located on opposing sides of said denture for producing and transmitting a output vibrations;

a power switch in electrical communication therewith said amplifier therethrough a tubular metal conduit located thereon an underside portion of said denture; and, a volume control means in electrical communication therewith said amplifier and said pair of output transducers located thereon an underside portion of said denture;

a battery compartment in electrical communication therewith said hearing aid located on an upper surface of said denture, comprising an enclosure providing a housing means therefor a battery;

a securing device threadingly attached thereto an outer surface of said battery compartment for securing said battery;

a perimeter seal providing a waterproof means thereto said battery; and, outwardly extending stainless steel support braces providing an attachment means therebetween said hearing aid and said user and further comprising a hollow electrical conduit means for allowing routing of wiring conducting an electrical output signal therefrom said hearing aid thereto said user;

loading said battery thereinto said battery compartment using and securing therewith said securing device;

inserting said denture thereonto an upper palate area of the mouth;

engaging said support braces thereto opposing upper rear molar pairs within said mouth;

securing said denture in place in a manner identical to conventional dentures or orthodontic plates;

activating said power switch therewith a tongue or finger of said user, thereby providing power from said battery thereto said hearing aid, wherein said input transducer produces said electrical output signal which is amplified by said amplifier;

wherein said conditioning circuit comprises conventional bandpass filters that remove unnecessary wavelengths from said electrical output signal prior to amplification;

wherein said amplifier provides a mechanical and an electrical attachment means thereto said pair of output transducers via said outwardly extending support braces;

wherein said pair of output transducers convert said electrical output signal into said output vibrations; and, wherein said output vibrations are conducted thereinto said user's teeth and facial bone structure, travel through said facial bone structure thereto an auditory system of said user, and processed and interpreted by said user into an audible signal;

adjusting said volume control therewith a tongue or finger of said user, thereby modifying a volume level of said electrical output signal; and, benefiting therefrom an improved and discrete auditory experience afforded said user.

* * * * *